US007726060B1

(12) United States Patent
Jones

(10) Patent No.: US 7,726,060 B1
(45) Date of Patent: Jun. 1, 2010

(54) FIREARM FASTENING ASSEMBLY AND METHOD OF USE

(75) Inventor: Jeffrey Allen Jones, Yorba Linda, CA (US)

(73) Assignee: J. Allen Enterprises, Inc., Yorba Linda, CA (US)

( * ) Notice: Subject to any disclaimer, the term of this patent is extended or adjusted under 35 U.S.C. 154(b) by 586 days.

(21) Appl. No.: 11/064,145

(22) Filed: Feb. 22, 2005

(51) Int. Cl.
*F41A 21/00* (2006.01)
*F41A 21/48* (2006.01)

(52) U.S. Cl. ..... 42/75.02; 42/75.03

(58) Field of Classification Search ..... 42/75.01, 42/75.03, 75.02
See application file for complete search history.

(56) References Cited

U.S. PATENT DOCUMENTS

| | | | |
|---|---|---|---|
| 4,199,886 | A | 4/1980 | Deuring |
| 4,312,146 | A | 1/1982 | Koon, Jr. |
| 4,385,464 | A | 5/1983 | Casull |
| 4,593,488 | A | 6/1986 | Ruger |
| 4,663,876 | A | 5/1987 | Reaume |
| 4,674,216 | A | 6/1987 | Ruger et al. |
| 4,691,462 | A | 9/1987 | Mattarelli |
| 5,423,145 | A | 6/1995 | Nasset |
| 6,070,354 | A | 6/2000 | Burigana et al. |
| 6,301,817 | B1 | 10/2001 | Hogue et al. |
| 6,457,273 | B2 | 10/2002 | Gussalli Beretta |
| 6,487,805 | B1 | 12/2002 | Reynolds |
| 6,539,659 | B2 | 4/2003 | Casas Salva |
| 6,637,142 | B1 | 10/2003 | Reynolds |
| 6,701,661 | B2 | 3/2004 | Murello |
| 6,820,533 | B2 | 11/2004 | Schuerman |
| 7,162,823 | B2 * | 1/2007 | Schoppman et al. ..... 42/75.01 |
| 2004/0211104 | A1 * | 10/2004 | Eberle ..... 42/71.02 |

OTHER PUBLICATIONS http://riflestocks.tripod.com/bedding.html Bedding the Stock: Glass Bedding, Pillar Bedding, Test Targets.

http://www.accurateinnovations.com/qolden_accuracy_stocks.html Accurate Innovations: Innovative Advantages: Pride of Possession, The Golden Accuracy™ series riflestocks.

http://www.accurateinnovations.com/stock_installation.html Accurate Innovations: Take Stock in this: Golden Accuracy stocks are "Completely finished, Drop in Ready".

http://www.agsfoundation.com/safety/qloss_all.html Americans for Gun Safety Foundation: Firearms Glossary.

(Continued)

*Primary Examiner*—Troy Chambers
(74) *Attorney, Agent, or Firm*—Greenberg Traurig, LLP

(57) ABSTRACT

A fastening assembly, method of use and associate kit for use in firearms assembly is provided. In one embodiment, at least one insert having at least a first mating portion and slanted surface is provided. A second mating portion is provided and is adjacent at least one of a receiver or barrel and configured to interlock and mate with the at least first mating portion. A stock is also provided, having at least one sidewall and at least one seating portion provided adjacent or integrated with the one sidewall and dimensioned to correspond and accept at least a portion of the insert. In particular embodiments, a fastener is also provided to fasten and secure the at least one insert to the at least one seating portion of the stock.

17 Claims, 6 Drawing Sheets

OTHER PUBLICATIONS http://www.bellandcarlson.com/Page3.html Bell and Carlson: Stock Specifications.

http://www.brownells.com/aspx/NS/store/ProductDetail.aspx?p=9899 &title=REMINGTON+700+PILLAR+BEDDING+BLOCKS Brownells: Remington 700 Pillar Bedding Blocks.

http://www.galleryofguns.com/shootingtimes/Articles/DisplayArticles.asp?ID=11 Davidson's Gallery of Guns.com Gun Review: Ruger 77/50 Muzzleloader: 7mm Remington Magnum: Is It the Ideal All-Around Hunting Cartridge?.

http://www.galleryofguns.com/shootingtimes/Articles/DisplayArticles.asp?ID=781 Davidson's Gallery of Guns.com Gun Review: Remington's First All-New Bolt Action Rifle in 33 Years: The Model 710.

http://www.getgrip.com/main/overview/overmolded.html Hogue, Inc. Product Overview: Rifle Stocks.

http://www.lonewolfriflestocks.com/stock_bedding_service.html Lone Wolf Riflestocks—Custom Rifles: Stock Bedding Service.

http://www.mcmfamily.com/mfsinc_n/faq.html McMillan Fiberglass Stocks: Frequently Asked Questions.

http://www.mcmfamily.com/mfsinc_n/tactical.html McMillan Fiberglass Stocks: Tactical Stocks: When Precision Shooting Is Not Just Your Passion, But Your Job Description.

http://www.remington.com/magazine/current/2004_0305.asp Remington: The Return of the Remington Bolt-Action Rimfire! The Remington rimfire that you grew up with is back in a totally new design and better than ever before.

http://www.rifle-accuracy.com Rifle Stocks: Get Pinpoint Accuracy With the SmartStock™.

http://www.varminthunters.com/tech/bedding.html Proper Action Bedding for the Precision High Power Rifle: Bedding Methods, Materials, Action Bedding.

http://www.weatherby.com/rifles/mag_ultralightweight.shtml Weatherby: Mark V Rifles for Magnum Cartridges: Ultra Lightweight.

Springfield Armory Rifles M1A™ Disassembly/Assembly, The Three Main Groups, Disassembly, M1A™ Standard Model Exploded View.

* cited by examiner

FIREARM FASTENING ASSEMBLY AND METHOD OF USE

RELATED APPLICATIONS

None

BACKGROUND

1. Field

The present disclosure generally relates to firearms. More particularly, the teachings of the present disclosure provide novel and effective firearm fastening assemblies, kits and methods of use for securing a firearm's receiver and/or barrel to another portion of a firearm, such as a stock.

2. Related Art

Since the beginning of the introduction and use of firearms in human history, various designs and means for assembling various components of firearms have been investigated and utilized. Typically, a firearm generally comprises groups of components, each one typically consisting of several additional subcomponents. These groups include the receiver, a barrel attached thereto and the stock. The stock provides a user a convenient element by which the firearm is typically carried and utilized, as known in the art.

Various methods have been utilized to bed or fit receivers and/or barrels into a stock. Stocks are typically provided with a top portion that is provided with an appropriate recess or recesses, shaped and formed to comport with the shape of the receiver and/or barrel fitted thereto. In some more modern and specialized firearms, such as benchrest and target/competition rifles, the barrels are free-floated, that is, the stock is shaped so that the barrel does not come in contact with the stock.

Previous methods for securing the receiver and/or barrels to the stock include clamping mechanisms or bands that clamp, directly or indirectly, the barrel and/or receiver to a stock. Such methods are typical found in early examples of firearms. Another method utilizes studs that depend from the underside of the receiver and/or barrel, the stock being appropriately recessed to accept and secure the studs and thus the receiver and/or barrel, to the stock.

Another very popular and widely utilized method for securing receivers and/or barrels to stocks incorporates threaded channels. Such channels are typically provided in the underside of a receiver and/or barrel, or are provided as part of a member depending therefrom. Screws of appropriate and sufficient length are provided that typically extend through the stock and engage the threaded channels, thus securing the receiver and/or barrel to the stock.

In particular configurations, such screws are provided fore and aft a trigger guard, which secures the trigger guard, and usually a floor plate, to the bottom of the stock while at the same time securing and bringing the receiver and/or barrel down into the stock's recess. In such configurations the floor plate and usually a rear tang of the trigger guard act as compression plates in contact with the bottom portion of the stock, securing the receiver into the stock. This configuration is the typical method by which many modern bolt-action rifles secure their receivers and barrels to stocks. Examples of rifles that incorporate such configurations can be found in the Remington Model 700 series of rifles, for example.

In another prior art method, the receiver is secured to the stock by utilizing a trigger housing group that includes a trigger guard that is hinged and can pivot about a point on a trigger housing group frame. The trigger guard can include a trigger guard extension arm, usually two arms, that includes a latch portion. Here, the receiver includes a projecting member that depends from a bottom portion of the receiver and includes a cutout or recess appropriately configured to comport with and engage the latch portion of the trigger guard extension arm. The receiver is dropped into the stock and the trigger housing group is inserted into the stock via the bottom of the stock, with the trigger guard in a forward position, thus positioning the latch portion of the trigger guard extension arm rearwardly (in the direction of the butt-end of the stock). Once the trigger housing group is so inserted into the stock, the trigger guard is swung rearwardly and up, thus bringing the latch portion of the trigger guard extension arm forward (toward the muzzle portion of the barrel), bringing the latch portion into engagement with the cutout or recess of the projecting member depending from a bottom portion of the receiver. This then results in a compression force that pulls the receiver and the trigger housing group towards each other and resultantly secures the receiver and trigger housing group to the stock. As, known in the art, this method does not require screws or other types of fastening. This is at least one reason that such configurations are found in some military and military-style rifles. An example of a firearm that utilizes such a configuration can be found one of the previous U.S. battle rifles, adopted in the 1950's, widely known as an M14, and such a receiver to stock securing configuration can also be found in the civilian version of this rifle, widely known in the art as an MIA, as produced by Springfield Armory (Geneseo, Ill. USA).

Although the various methods above are widely utilized, they can still permit substantial movement of the receiver in the stock. Use of securing forces associated with the use of screws and associated configurations can be lost due to handling of the rifle and particularly due to recoil generated during the firearms' firing as well as disassembly and reassembly. Similarly, the configuration utilizing compression between a trigger housing group and the cutout or recess of a projecting member depending from a bottom portion of the receiver can also be subject to shifting and associated loses in accuracy.

Stability and maintenance a "perfect fit" is especially important to those marksmen and shooters that pursue an exacting and tight fit between the receiver and stock. Such shooters can employ a well known method, which utilizes fiberglass compositions, to glass bed their actions to the stock to achieve that "perfect fit". There is an interesting irony to glass bedding in that once the expense and trouble associated with such bedding jobs, executed to increase accuracy of a particular firearm, have been overcome, the gained stability and accuracy of the firearm is eventually diminished over time. This is because in addition to the effects of recoil on the bedding (e.g., upward and rearward thrusting, torque and vibration forces exerted on the components of the firearm), the gained effect is further diminished by the servicing of the now glass-bedded rifle. Removing and reinstalling the action for cleaning/service aggravates the bedding with every disassembly-re-assembly cycle, thus hastening the necessity for a bedding touch-up or complete re-bedding. In some circumstances and after a sufficient number of disassembly-re-assembly cycles, wear on the factory latches of a trigger housing group (e.g. like the ones utilized in M1A/M14-type rifles) the can proceed to a point for which the only remedy is replacement of the whole of the trigger group.

SUMMARY

In one aspect of the present disclosure, a firearm fastening assembly is provided comprising at least one insert having at least a first mating portion, the at least one insert having an overall shape, and at least one second mating portion provided as part of or adjacent at least one of a receiver or barrel. The at least one second mating portion is configured to interlock and mate with the at least first mating portion of the at least one insert. A stock having at least one sidewall and at least one seating portion is also provided. The at least one seating portion is provided adjacent or integrated with the at least one sidewall and dimensioned to correspond, at least in part, with at least a portion of the at least one insert and to accept at least a portion of the at least one insert. The at least one insert, in one exemplary implementation, optionally is configured to accept a fastener to fasten/secure the at least one insert to the at least one seating portion of the stock.

In particular embodiments, the at least first mating portion of the at least one insert is a protuberance depending from the at least one insert. The at least one second mating portion can comprise at least one recess into which the protuberance fits and interconnects to interlock one with the other. In particular embodiments, the first mating portion and second mating portions are reversible, that is, the second mating portion being provided by the insert and the first mating portion being provided by at least one of a receiver or barrel, or more particularly, as part of a member depending therefrom.

In still other embodiments, the at least one insert has top, bottom, front and rear surfaces, the at least one insert having at least one inclined surface, the at least one inclined surface having an inclination relative to at least one of the top or bottom surface. The inclination in particular embodiments can be greater than a ninety degree angle, as defined and measured from the inclined surface and the bottom surface of the insert. In other embodiments, the inclination or slant can be defined as the angle defined between the top surface and the inclined surface, such angles being the internal angles of the contour or shape defined by the insert. In exemplary embodiments, the inclination of the at least one surface provides the at least one insert with a wedge-shaped contour.

In exemplary embodiments, the at least one seating portion of the stock includes a cam surface which is inclined and matches the at least one inclined surface of the at least one insert. In particular embodiments, the at least one insert further comprises at least one rail portion adjacent and depending from at least one of the front, rear or bottom surfaces of the at least one insert. In another aspect, the firearm fastening assembly includes at least one seating portion that has at least one groove into which the at least one rail portion of the at least one insert corresponds and fits into.

In particular embodiments which include a fastener, the fastener comprises a spirally grooved cylinder and the at least one insert includes a correspondingly grooved hollow cylinder into which the spirally grooved cylinder fits, in order to seat and tighten the at least one insert into the at least one seating portion of the stock.

In particular embodiments, the stock includes a support railing that contains the at least one seating portion. In such embodiments the stock includes the support railing. Such stocks are exemplarily provided by placing the support railing, including the at least one seating portion, into a mold and an outer portion of the stock is formed around the support railing, such as by injection molding, for example, to provide a stock that incorporates the support railing having the at least one seating portion into which the at least one insert is seated and fits.

In particular embodiments, and where so included and utilized, the fastener of the at least one insert utilized to fasten and/or secure the at least one insert into the at least one seating portion. The fastener can be selected from the group consisting of a bolt, a peg, a rivet, a latch or any combination thereof, for example. In particular embodiments, an adhesive can be applied to the insert to secure the insert into the seating portion.

In various embodiments, the at least one insert, having the various characteristics described herein, is made of, but not limited to, a material, wherein the material is or includes any one or combination of steel, alloy, aluminum, titanium, plastic, nylon, polycarbonate or derivative thereof, polypropylene, polyethylene, polyvinyl chloride (PVC), polymer reactants, such as urethane and epoxy alone or in any useful combination, fiberglass, poly-paraphenylene terephthalamide fibers (KEVLAR®, DuPont Advanced Fibers Systems, Richmond, Va.), carbon fibers or graphite.

In still other exemplary embodiments, the at least one seating portion is comprised and provided having of any one or combination of steel, wood, laminated wood, aluminum, titanium or plastic, nylon, polycarbonate or derivative thereof, polypropylene, polyethylene, polyvinyl chloride (PVC), polymer reactants, such as urethane and epoxy alone or any useful combination, fiberglass, poly-paraphenylene terephthalamide fibers (KEVLAR®, DuPont Advanced Fibers Systems, Richmond, Va.), carbon fibers or graphite.

In particular embodiments, the firearm fastening assembly includes at least one second mating portion provided as part of a member depending from at least one of a receiver or a barrel. In a particular implementation, the at least one second mating portion of the member depending from the at least one of a receiver or barrel is a recess of sufficient width to accept the first mating portion of the at least one insert and a latch portion of a trigger guard extension arm.

In another aspect, a fastening assembly system for fastening a receiver of a firearm to a firearm stock is also disclosed, comprising a firearm receiver having a barrel attached thereto and at least one member depending from at least one of the receiver or barrel and a stock having a sidewall and at least one seating portion, the at least one seating portion being provided adjacent or integrated with the at least one sidewall and dimensioned to correspond, at least in part, with at least a portion of an outer perimeter or contour of at least one insert, the at least one insert having at least one first mating portion, wherein the at least one first mating portion corresponds to and engages at least one second mating portion provided as part of the at least one member depending from the firearm receiver or barrel. In particular embodiments, at least a pair of members depending from the firearm receiver or barrel are provided. In some embodiments, the pair is provided such that one depends from a left portion of a receiver adjacent a left side of the stock and the other depends from a right portion of the receiver adjacent a right portion of the stock. Such pairs of members may be provided aligned or unaligned with each other.

In other exemplary embodiments the at least one insert includes a top, bottom, front and rear surfaces, the at least one insert having at least one inclined front or rear surface relative to at least one of the bottom or top surface of the at least one insert. In particular exemplary embodiments, the first mating portion of the at least one insert is a protuberance having a first mating contour. In particular embodiments, the protuberance is provided having a radial contour or substantially radial contour. Other contours may be utilized, such as a dove tail, for example, which will fit with the second mating portion having an appropriately corresponding complementary contour (e.g. inter-fitting/interlocking). In some embodiments, inserts can be provided with a plurality of first mating portions which correspond and interlock with a plurality of second mating portions, in accordance with the teachings provided herein.

In still other exemplary embodiments, the at least one protuberance is provided on and emanates from a surface of the at least one insert that is opposite the at least one inclined front or rear surface. In accordance with the teachings provided herein, exemplary fastening assembly systems can include at least one insert having at least one rail situated along at least a portion of the at least one insert's perimeter, the at least one rail corresponding to at least one groove of the seating portion of the stock into which the at least one insert fits. In particular exemplary embodiments, the at least one insert includes at least one rail situated along at least a portion of the at least one insert's perimeter and the at least one rail is provided at an inclination or slant that matches or substantially matches at least one inclined front or rear surface of the at least one insert.

The present disclosure also provides a method for securing a firearm receiver to a stock, comprising the steps of providing a receiver having at least one first mating portion of a fastening assembly, providing at least one insert wherein the insert includes at least one second mating portion of the fastening assembly, wherein the at least one insert has a contour and at least one protuberance depending/emanating from at least one surface of the at least one insert. A stock having at least one sidewall and at least one seating portion is provided, the at least one seating portion being provided adjacent or integrated with the at least one sidewall and is dimensioned to correspond with at least a portion of the contour of the at least one insert. The at least one mating portion is aligned with the at least one second mating portion in order to engage the corresponding mating portions with one another, positioning the at least one insert and receiver into the stock, the at least one insert being aligned and seated into the seating portion; and securing the at least one insert into the at least one seating portion of the stock. In particular embodiments, at least two inserts and two seating portions are provided on opposite sides of a stock and in opposition with one another.

In particular exemplary embodiments, the at least one mating portion is provided by at least one member depending from said receiver or from a barrel attached to the receiver. In still another aspect, exemplary embodiments include at least one second mating portion having a protuberance that fits and corresponds in shape to said at least one first mating portion of the receiver, the first mating portion being a recess having complimentary dimensions to the protuberance. In particular embodiments, an exemplary method can include a step of applying and utilizing a fastener to secure the at least one insert into the at least one seating portion of the stock. Exemplary fasteners and configurations include, but are not limited to, a screw, a bolt, interlocking teeth on a surface of the insert and a surface of the seating portion, a releasable clasp, such as an over-center clasp (e.g. a cammed clasp such as those utilized on fishing tackle boxes to secure a top and bottom hinged portions of the box together) or ratchet-type configuration where the insert has a set of angled teeth wherein and in which a pawl, cog, or tooth/teeth or other complementary engagement means of the seating portion engages the insert's set of angled teeth, allowing motion in one direction only. Exemplary surfaces of the insert where a tooth or teeth are provided and the stock's seating portion where the set of angled teeth in which a pawl, cog, or tooth/teeth or other complementary engagement means of the seating portion are provided, include any one or combination of adjacent front, back, bottom or side surfaces of the insert and the seating portion.

Exemplary embodiments can also further comprise the step of removing the fastener after securing the at least one insert into the at least one seating portion of the stock. In an exemplary method, the at least one insert further comprises top, bottom, bottom, front and rear surfaces, the at least one insert having at least one inclined surface, the at least one inclined surface having an inclination relative to the top or bottom surfaces. The inclination provides the at least one insert with at least one wedge shaped surface or contour. In particular embodiments, the at least one insert includes at least one rail along an outer portion of the at least one insert, the rail fitting into a corresponding grove in the seating portion of the stock.

In still other exemplary method embodiments, the at least one insert includes at least one rail, the at least one rail fitting into a corresponding groove in the seating portion of the stock, wherein the at least one rail is adjacent and along least one inclined surface of the at least one insert, the at least one rail and the corresponding groove in the seating portion being provided having angles of inclination that comport with one another and provide secure seating and alignment of the at least one insert into the at least one seating portion of the stock.

In still another aspect, a kit for fastening a firearm receiver to a stock is also provided by the teachings of the present disclosure. In one embodiment, an exemplary kit can comprise a stock having at least one sidewall and at least one seating portion, said at least one seating portion being provided adjacent or integrated with the at least one sidewall and having an inclined cam surface, and at least one insert, the at least one insert having an overall contour and top, bottom, front and rear surfaces, wherein at least one of the front or rear surfaces is an inclined surface and comports with the inclined cam surface of the seating portion, the at least one insert having at least one first mating portion that interlocks and fits with a complementary second mating portion of a receiver and/or barrel. In particular embodiments, the kit's insert interlocks with a complementary second mating portion of a firearm receiver, which can be provided by at least one member depending from a receiver and/or barrel. In particular embodiments, the at least one depending member includes a cutout or recess portion as the complementary second mating portion and the at least one insert's at least one first mating portion includes a protuberance that has a contour that corresponds or substantially corresponds to the cutout or recess portion of the complementary second mating portion of a receiver and/or barrel. The kit can also utilize and include a fastener for fastening and/or seating the at least one insert into the at least one seating portion of the stock. The kit can also include, in one embodiment, a washer, that is utilized in conjunction with at least one fastener, placed and disposed between a head portion of a fastener and a surface of the stock. At least one washer can also be utilized as a part of the various embodiments disclosed herein In still other embodiments, multiple inserts can be provided as part of the kit, the multiple inserts differing in thickness such that a user can mount a particular receiver to a stock provided as part of the kit, such that a very tight and straight alignment of the receiver and the stock can be achieved. In particular exemplary embodiments, the fastener included in various embodiments of the kit can be, although not limited to, at least one of a bolt, a screw, interlocking teeth or a releasable clasp or any combination thereof. An adhesive, such as, but not limited to an epoxy or other adhesive or resin, can also be provided as part of the kit, to secure the kit's insert into a stock's seating portion.

Various additional objects, features and advantages of the present invention can be more fully appreciated with reference to the detailed description and accompanying drawings that follow.

DETAILED DESCRIPTION OF THE INVENTION

Descriptions of exemplary embodiments are provided and reference made to the accompanying figures which form the part thereof, and which are shown by way of illustration of exemplary implementation of teachings provided herein. It is to be understood that other embodiments and application of the teachings provided herein may be utilized and structural and functional changes may be made without departing from the spirit and scope of the present disclosure. Additionally, the figures are for illustrative purposes and no relative or limiting sizes or ratios are intended.

Figure 1:
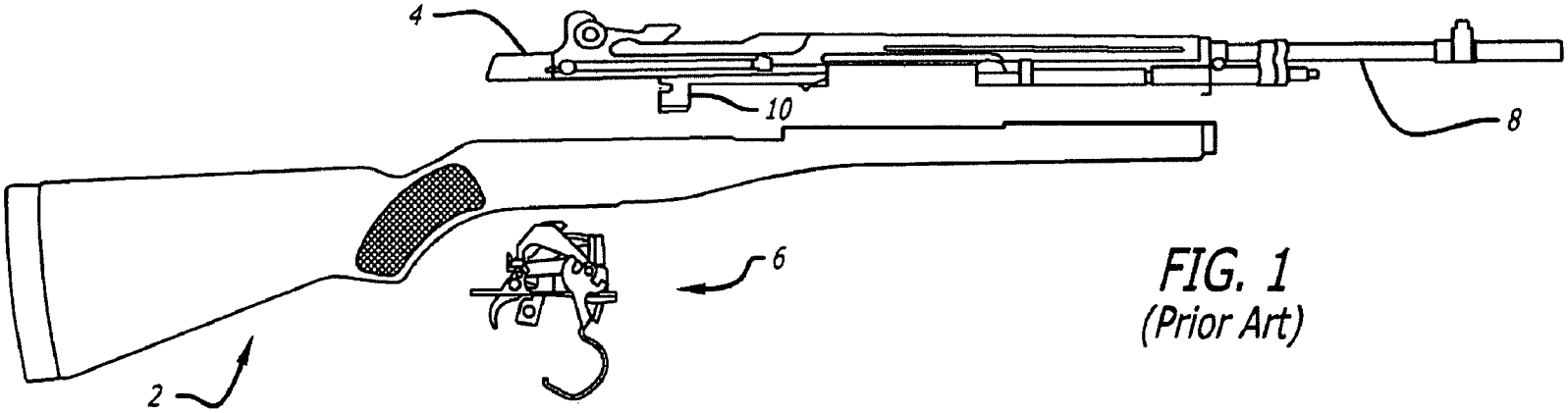
FIG. 1 (Prior Art)
FIG. 1 is an exemplary depiction of one prior art method for securing a firearm's receiver to a stock utilizing components of a trigger housing group to engage a member depending downwardly from a receiver.

Now turning to FIG. 1, an exemplary schematic of one prior art method for securing a receiver 4 of a firearm to a stock 2 is shown. Receiver 4 has a barrel 8 attached thereto. Here, the means for securing receiver 4 to stock 2 utilizes components of a trigger housing group 6. In particular, receiver 4 is secured to stock 2 by utilizing a trigger housing group 6 that includes a trigger guard 42 that is hinged and can pivot about a point on a trigger housing group frame. The exemplary trigger guard 42 includes two trigger guard extension arms (the closest one of the two trigger guard extension arms is shown in this side view), which straddle the trigger housing group frame. Each trigger guard extension arm includes a latch portion that engages one of a pair of depending members (here again only one depending member 10, is shown in this side view) which downwardly depend from a bottom portion of receiver 4, as shown. Each depending member includes a cut-out/recessed mating portion to which the latch portion of each extension arm fits and engages. This is an exemplary known method in the art to secure receiver 4 to stock 2 and is the method typically employed in the civilian M1A (Springfield Armory Geneseo, Ill. USA) and related rifles.

Figure 2:
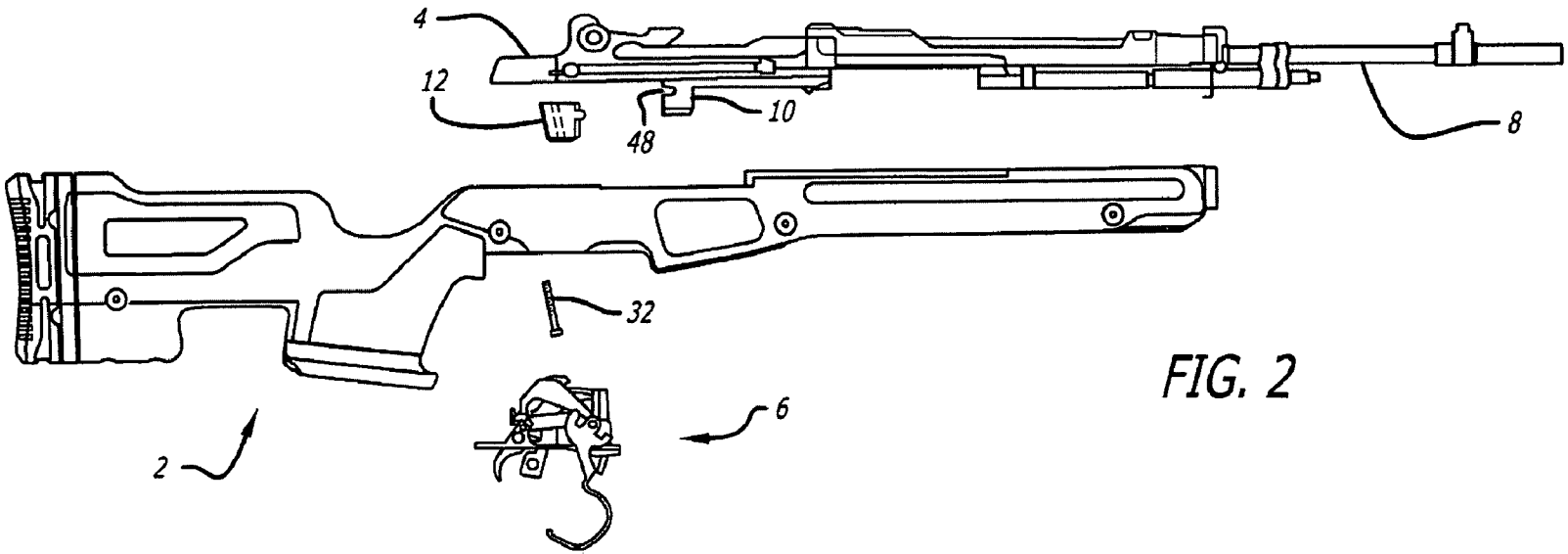
FIG. 2 is a depiction of an exemplary configuration in accordance with the teachings provided herein.

Turning to FIG. 2, an exemplary rifle is depicted showing various embodiments of various elements in accordance with the present disclosure. In this one exemplary embodiment receiver 4, barrel 8 and trigger housing group 6 are substantially similar to those shown in FIG. 1. Here, however, a unique and exemplary fastening assembly is provided, wherein at least one insert 12, by its overall shape and contour, provides a first mating portion which is utilized to engage with at least one second mating portion provided as part of or adjacent at least one of receiver 4 and/or barrel 8. In this particular embodiment, second mating portion 48 is a cut-out or recess provided as part of depending member 10. This particular embodiment wherein engagement of insert 12 with depending member 10 and resultant securing of receiver 4 to stock 2 is described in further detail below.

Figure 3:
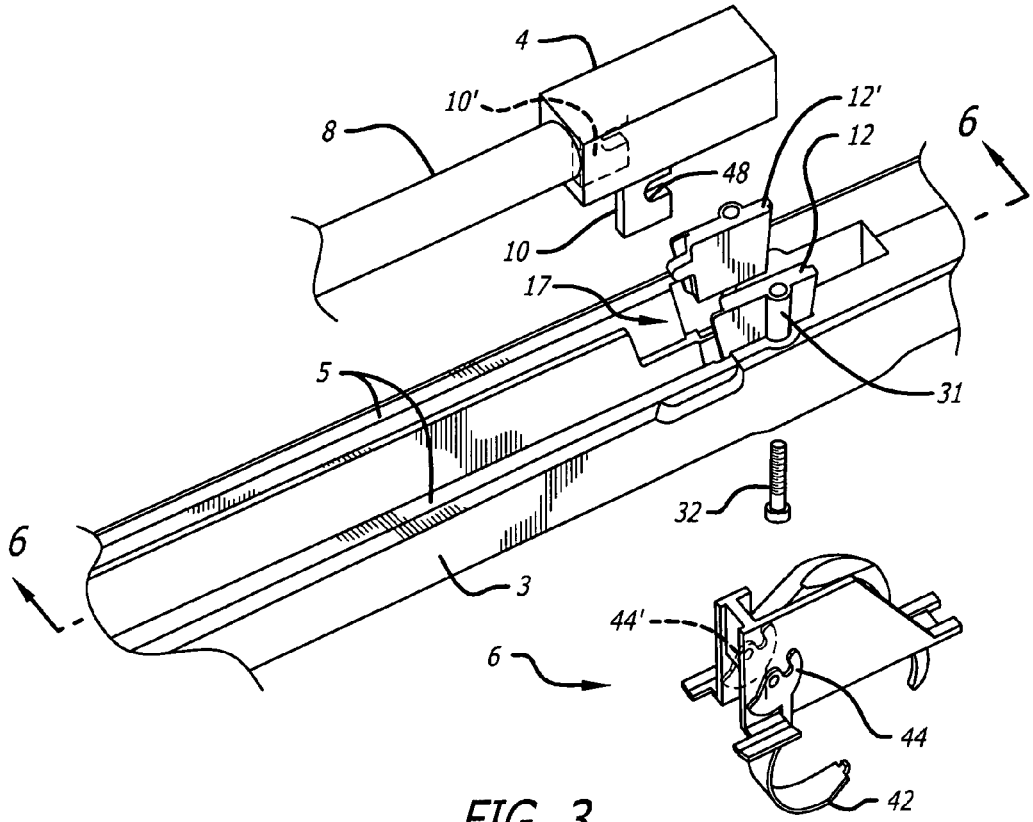
FIG. 3 is an exemplary schematic showing exemplary support railing, receiver, barrel, depending members and two inserts and other exemplary components in accordance with one embodiment.

FIG. 3 is a schematic showing an exemplary support railing 5, receiver 4, barrel 8, a pair of depending members 10-10 and two inserts 12-12 along with other exemplary components, in accordance with an exemplary embodiment. As shown here, depending members 10 and 10' each depend from a bottom portion of receiver 4, and each have a cut-out or recess which can be referred to as at least one second mating portion 48. Likewise, a plurality of inserts, such as two for example, can be provided in accordance with the present disclosure, as shown and indicated as 12 and 12'. Again and likewise in an exemplary embodiment, exemplary trigger guard 42 can include two trigger guard extension arms 44 and 44'. As depicted here, the components that are not in view or are blocked due to the viewing angle are illustrated by dotted lines. Such complementary components are typically aligned with each other when viewed from a direct side view, and thus appear superimposed from such angles. Therefore, FIG. 3 is provided as a perspective view to show the relative position of various components. When "prime" reference numerals are utilized, this typically denotes a distal component as viewed from the provided perspective of the Figure. In FIG. 3 for example, latch portion 44 is closer (proximal to the viewer) to the viewer than latch portion 44', which is distal to the viewer and is located at the far side of trigger housing group 6. These views and arrangements holds true for depending members 10 and 10' and inserts 12 and 12' as well. Furthermore, elements or components having "prime" designations/numerals can be considered mirror images of corresponding elements having non-prime reference numerals and descriptions and discussions in regard to one can apply to the other.

In FIG. 3, various components are depicted. Inserts 12 and 12' are shown partially seated in their respective seating portions of stock 2. As shown in FIG. 3 and in this exemplary embodiment, seating portion 17 can be provided as part of stock's 2 sidewall, here provided as an inner-facing surface of support railing 5. Support railing 5 can be utilized and provided as either a primary or secondary reinforcement structure that is part of and incorporated into an inner portion of stock 2. The incorporation of metallic or alloy support and reinforcement structures into components made of synthetic material utilized in the firearms industry, is generally well known in the art, particularly in the production of stocks and other firearm components/parts made of synthetic materials. Such synthetic materials can be and/or include, but are not limited to, nylon, plastic, fiberglass, epoxy, urethane, polycarbonate, polypropylene, polyethylene, polyvinyl chloride (PVC), carbon fiber, graphite, poly-paraphenylene terephthalamide fibers (KEVLAR®, DuPont Advanced Fibers Systems, Richmond, Va.), and can provide and comprise an outer portion 3 of stock 2. Such materials are typically utilized in various injection molding manufacturing techniques wherein such support and reinforcement structures are placed into a stock mold and the synthetic materials are introduced to form the stock having the support and reinforcement structures incorporated therein, commonly referred to as "insert molding" in the art. Alternative manufacturing methods include but are not limited to lamination of successive layers of any combination of fiberglass, carbon, graphite, poly-paraphenylene terephthalamide fibers (KEVLAR®, DuPont Advanced Fibers Systems, Richmond, Va.) through the use of hand lay-up, vacuum bagging and pressure forming. In this particular embodiment, support railing 5 includes at least one seating portion 17 into which at least one insert, for example insert 12, comports and fits into. Support railing 5 can be made of one or any combination of steel, aluminum, titanium, high impact plastic, nylon, polycarbonate or derivative thereof, polypropylene, polyethylene, polyvinyl chloride (PVC), and/or polymer reactants such as urethane and epoxy, fiberglass, poly-paraphenylene terephthalamide fibers (KEVLAR®, DuPont Advanced Fibers Systems, Richmond, Va.), carbon fiber or graphite. In a particular embodiment, least one seating portion 17 can include a bottom seating portion surface 36 into which depending member 10, for example, as well as bottom surface 52 of insert 12, fits into and abuts once properly secured to stock 2. Support railing 5 and associated seating portion 17 can be manufacturing utilizing well known machining, casting or forging methods, sintering and 3-D lithography, as well known in the art. While, seating portion is depicted particular embodiments as being formed as part of support railing 5, seating portion can be provided alone and as part of the internal portion of a stock not having other portions of support railing 5, for example.

Also shown in FIG. 3 is a fastener 32, which is inserted into insert 12 and is utilized to securely tighten and fasten at least one insert 12 into at least one seating portion 17 of stock 2. Of course and in this embodiment, a second fastener (not shown) is similarly utilized and applied to insert 12', when so provided in particular embodiments. In one embodiment, the fastener 32 can be, but is not limited to, a bolt, a screw, a pin, a rivet, for example. In particular embodiments, at least one washer can be provided and utilized with a provided fastener, as known in the fastening arts. In some embodiments, after fastener 32 is tightened and utilized to seat an insert, such as insert 12' for example, into an appropriate seating portion 17 for example, the fastener 32 is retained in the secured and locked position. In some embodiments, for example when fastener 32 is a screw, bolt or provided as a removable element, fastener 32, after being utilized to sufficiently tighten and seat an insert into the appropriate seating portion of the stock, can be removed and there is no loss in the strength of the seating of insert 12 and securing of receiver 4 to stock 2, owing to the particular configuration of at least one side of insert 12. In particular embodiments, an adhesive, such as an epoxy, for example, can be applied to at least one surface of insert 12 that abuts a surface of seating portion 17, such that when the insert 12 is seated therein, the adhesive forms a tight bond between the insert 12 and the seating portion 17 in the sidewall of stock 2. As illustrated in one embodiment, seating portion 17 is provided as part of support railing 5, which is part of the internal portion of stock 2, which is dimensioned to accept receiver 4.

In particular embodiments, seating portion 17 can be provided as a portion of stocks that are made of wood or laminated wood, for example.

Figure 4:
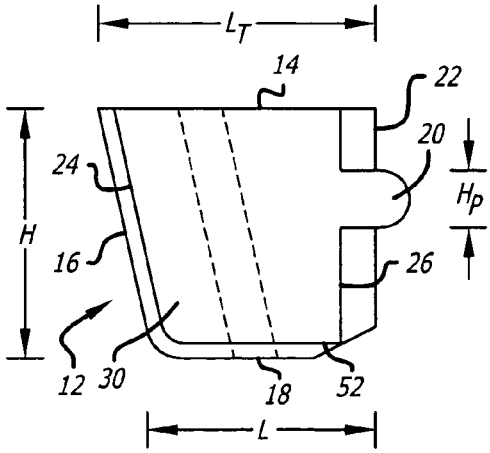
FIG. 4 is a side view depiction of an exemplary insert in accordance with the teachings provided herein.

One embodiment of insert 12 is depicted in FIG. 4. In this embodiment, insert 12 has a front surface 26, a rear surface 24, a top surface 14 and a bottom surface 52 and inward facing surface 30. Inward facing surface 30 faces the midline of the firearm or stock. Insert 12 also has at least one first mating portion, here the first mating portion being a protuberance 20 depending from insert 12. While protuberance 20 is depicted in this embodiment as having a rounded contour, protuberance 20 can be provided having any appropriate shape and contour, for example and not limited to, a triangular or square contour, as long as the protuberance of the first mating portion fits and interlocks with the complimentary second mating portion 48. In the embodiment depicted in FIG. 3, the second mating portion 48 provided by depending member 10 is a recess or cutout portion having a rounded contour that is complimentary to the contour of protuberance 20.

Insert 12 can be provided having various dimensions. In one embodiment and in reference to FIGS. 4 and 5, insert 12 can have a top length ($L_T$) of about 1½ inches, a height (H) of about 1 3/16 inches, bottom length ($L_B$) of about 1⅛ inches. Protuberance 20 has a height ($H_P$) of about ¼ inch, width/thickness ($W_P$) of about ⅛ inches and length ($L_P$) of about ¼ inch. Rails 16 and 18 can be provided with a width ($W_R$) of about ⅛ inch and set in about ⅛ of an inch from the inward facing surface 30 of insert 12. Insert 12 can have a width ($W_I$) of about 3/16 inch. Accordingly, seating portion is provided with the appropriate configurations and dimensions to accommodate insert 12. Such dimensions and relative ratios of various dimensions to each other are only for illustrative purposes only, and various other dimensions and relative ratios can be utilized in accordance with the teachings provided herein.

In this embodiment, insert 12 is provided with at least one inclined surface relative to at least one of the top surface 14 or bottom surface 52. In one embodiment, inclined surface is rear surface 24. This particular embodiment also includes at least one rail portion, that runs along at least a portion of one surface of insert 12. Insert 12 shown in FIG. 4 has a rear rail portion 16 and a bottom rail portion 18. In this embodiment, rear rail portion 16 and bottom rail portion 18 run along the length of rear surface 24 and bottom surface 52 and are continuous, although the rails can be provided such that they do not meet with each other at a corner of insert 12. While rails so depicted in this particular embodiment can be configured and provided to run along substantially the entire length of rear surface 24 and bottom surface 52, a rail or rails can be provided to run along only a portion of the length of their respective surfaces. Accordingly, grooves provided in seating portion 17 and into which such rails fit are correspondingly provided and configured. Insert 12 also has a forward lip 22. The various rails, surfaces and lip fit into corresponding recesses/grooves provided in seating portion 17.

Figure 5:
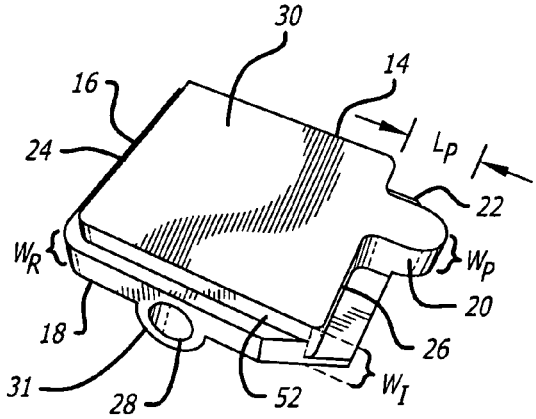
FIG. 5 is a bottom perspective view of the exemplary insert of FIG. 4.

FIG. 5 depicts a perspective bottom view of insert 12 shown in FIG. 4. From this perspective an opening 28 is shown at the bottom of insert 12, which is one end of a hollow passage provided within insert 12 and into which fastener 32 is inserted and secured. In this embodiment, the hollow passage begins at the bottom of insert 12 and runs internally and at a non-perpendicular angle relative to the bottom of insert 12. In this embodiment, insert 12 includes an outer radial portion 31 that aligns with seating portion 17, as discussed below. In some embodiments, the hollow passage is at an angle that matches or substantially matches (i.e., is substantially parallel to) the inclination of rear surface 24. In some embodiments, the hollow passage can be provided substantially perpendicular to the bottom of insert 12. In still other embodiments, the hollow channel can be inclined toward front surface 26, forming an acute angle between bottom surface 52 and front surface 26.

In particular embodiments, the hollow passage has internal configurations in accordance with the type of fastener 32 utilized. For example, when fastener 32 is provided with a spirally grooved cylinder, such as is found on screws and bolts, for example, the hollow passage is configured as a correspondingly grooved hollow cylinder into which fastener 32 with the spirally grooved cylinder fits and is tightened. As exemplarily shown here, such tightening of fastener 32 results in drawing down and securing of insert 12, with its first mating portion interlocked and fitted with the second mating portion 48 of depending member 10, into seating portion 17 to secure receiver 4. The interlocking and joining of the mating portions is further discussed below and shown in FIGS. 8-12.

The inserts, 12 and 12', can be made out of any one or combination of a metal, metal alloy or composites, as disclosed above. Exemplary metals can be, but not limited to, aluminum, steel, titanium, etc, and can be machined, cast or forged, as well known in the art.

Figure 6:
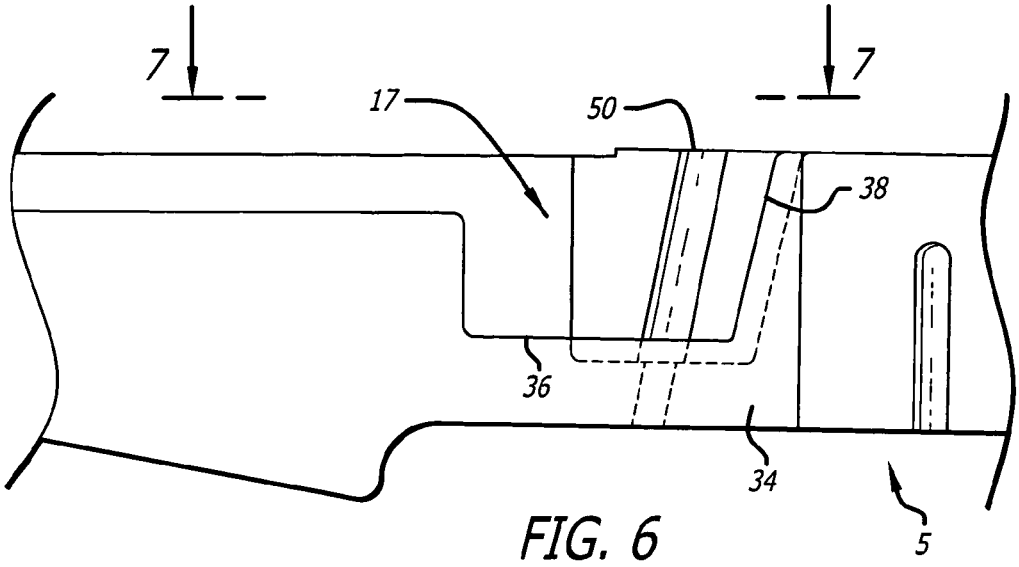
FIG. 6 is a schematic depicting an exemplary side view of an internal portion of an exemplary stock along line 6-6 in FIG. 3, showing an exemplary seating portion.

FIG. 6 depicts an exemplary side view of an internal portion of an exemplary stock's opening, taken along line 6-6 (which is a midline of stock 2) in FIG. 3, showing an exemplary seating portion 17, here provided as part of support railing 5 that is part of stock 2. Support railing 5 has an inward facing surface 34 that faces the midline of stock 2 and provides one sidewall. FIGS. 6-10 only depict a half of support railing, for clarity of viewing the various elements. As shown in the embodiment depicted in FIG. 3, both (two) halves of support railing 5 are shown. In various embodiments, support railing can be formed and provided as multiple components or two halves that are then joined together, as shown in FIG. 3, or the whole of support railing can be manufactured and provided as one piece and incorporated into the stock.

As shown in FIG. 6, seating portion 17 includes a bottom seating portion surface 36 and a cam surface 38. A groove (hidden and shown in dashed lines at a bottom and rear portion of seating portion 17) are provided to accommodate rails 18 and 16, respectively. Shown in dashed lines In this embodiment, cam surface 38 is inclined and substantially matches the incline or slant of rear surface 24 of insert 12. There is also provided a seating portion channel 50, that aligns with outer radial portion 31 of insert 12 which is at substantially the same slant inclination of the hollow passage provided within insert 12 and into which fastener 32 is inserted and secured.

Figure 7:
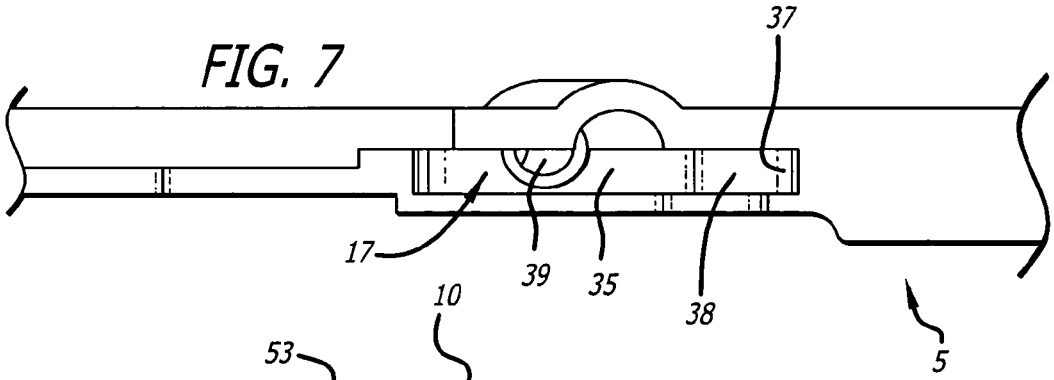
FIG. 7 is a top view of the an exemplary seating portion of FIG. 6.

FIG. 7 is a top view of support railing 5, in accordance with the arrows labeled "seven" in FIG. 6. As seen from above, grooves 37 and 35 are provide in seating portion 17, into which rear rail portion 16 and bottom rail portion 18 of insert 12 align and fit into, respectively. Also seen is fastener aperture 39, through which fastener 32 passes and engages the hollow passage of insert 12. Fastener aperture 39 may or may not be spirally grooved, in accordance with the type of fastener 32 utilized in a particular embodiment.

Figure 8:
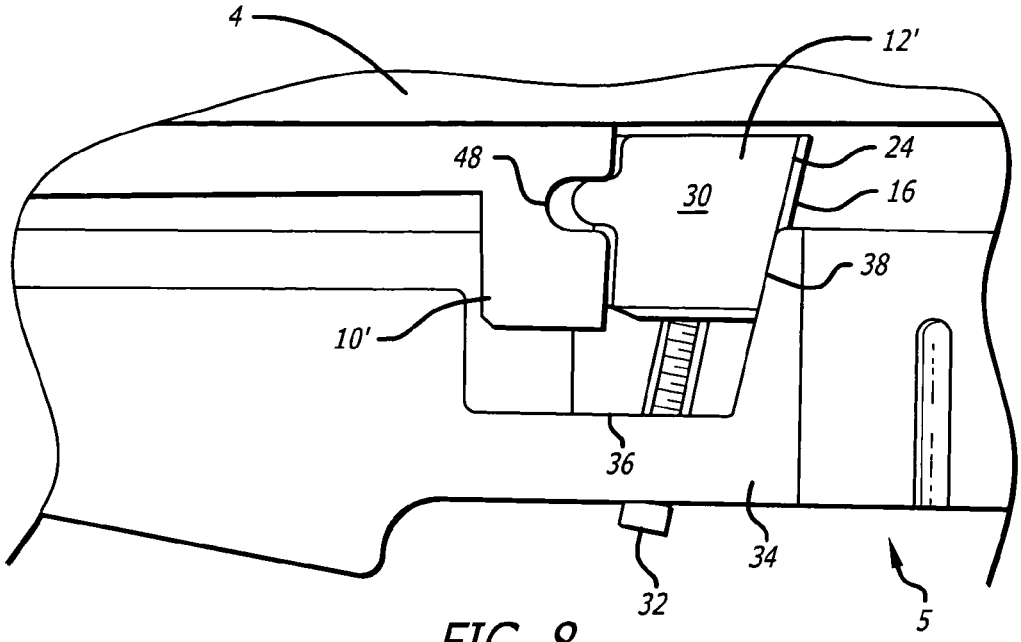
FIG. 8 is a schematic depicting a receiver, depending member, insert, fastener and complementary fitting portions of exemplary depending member and exemplary insert, during insert fitting into a seating portion of a stock, in accordance with one embodiment.

In a particular embodiment, fastening of receiver 4 to stock 2, via seating portion 17, is shown in FIG. 8, in a side view along line 6-6 of FIG. 3. Receiver 4, having at least one first mating portion 48 of a fastening assembly, is positioned to align with and interlock with a provided at least one second mating portion of insert 12'. Here the depending member 10' provides the first mating portion 48. Insert 12' has a contour that matches at least a portion of seating portion 17 and also has at least one protuberance depending from at least one surface, as shown previously. The stock, here having support railing 5 and seating portion 17 at a sidewall, includes seating portion 17 provided adjacent or integrated with at least one sidewall and dimensioned to correspond with at least a portion of the contour of at least one insert, here insert 12'. After aligning and interfitting the mating portions of insert 12' and depending member 10' which depends from receiver 4, insert 12' is aligned with seating portion 17. Insert 12' and receiver 4 and depending member 10' are then lowered onto/into stock 2 and seated appropriately. Such alignment, interfitting, lowering and seating steps can be performed in any useful order or combination. For example, the receiver and depending member can be lowered or approach a stock having the insert or inserts already partially fitted into appropriate seating portion or portions, wherein the aligning and interfitting steps of the mating portions are then performed, after which at least one insert completes its lowering and seating into its respective seating portion. Optionally, at least one fastener 32 is passed through fastener aperture 39 and engages the hollow passage of insert 12' and, in the embodiment illustrated being a threaded fastener, fastener 32 is turned and tightened to draw down insert 12' into seating portion 17, along with depending member 10' and attached receiver 4. Rear rail 16 and rear surface 24 of insert 12' engage and contact cam surface 38 and groove 37 of seating portion (bottom rail 18 also will fit into groove 35 once insert 12' is fully seated, not shown). Since such an advantageous wedge shape is provided, the further down and tighter insert 12' is seated in seating portion 17, the overall fastening of the receiver 4 to stock 4 is increased and the tighter the fit of receiver to stock. Advantageously, such a provided configuration actually results in a tightening and further securing of receiver 4 to stock 2 during firearm firing. Similar to a wedge-shaped doorstop, the upward force of recoil actually is transferred to further seat the inserts, 12 and 12', into their respective seating portions in the stock 2, thus further wedging and tightening inserts 12 and 12'. Since inserts 12 and 12' are mated and interlock with mating portions of the receiver, this increase in fastening is also relayed to receiver.

As can be seen, by providing a paired combination of inserts and depending members (as depicted in FIG. 3, for example, on a right and left side of stock 2) provides a user the unique and novel ability to adjust the longitudinal alignment of the receiver/barrel with a centerline of the stock. This can be accomplished, for example, via independently adjusting the receiver/barrel via torque applied to a pair of fasteners 32 that engage inserts 12, and 12', respectively. For example, when the respective fasteners 32 are threaded, the user can vary/adjust the applied torque to a left side or right side fastener 32 by simply tightening or loosening the respective fastener 32 (recall engagement of fastener 32 with insert 12, via hollow passage provided within insert 12, appropriately threaded/grooved, of course) on the right or left side of stock 2. Thus with a pair of such configurations so provided (See FIG. 3 for example), longitudinal alignment of the receiver/barrel with the centerline of the stock is efficiently accomplished via independent torque adjustment of left and right side fasteners 32, respectively.

Figure 9:
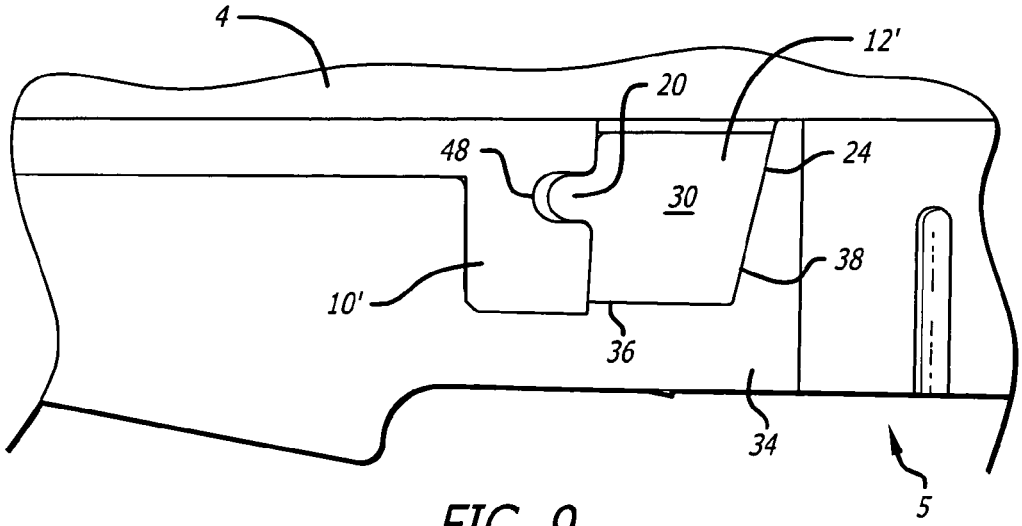
FIG. 9 is a schematic of a receiver, depending member and insert seated in the seating portion of the stock, tightened and secured via the fastener, in accordance with one embodiment.

FIG. 9 shows receiver 4, depending member 10' and insert 12' fully seated in the seating portion 17 of the stock, tightened and secured via fastener 32 (not shown as it is drawn into fastener aperture 39), in accordance with one embodiment. Recall that this view is along line 6-6 of FIG. 3, and that in this embodiment, the same alignment, interlocking and insert seating and fastening and all other elements/components and configurations are mirrored in the other half of the embodiment (see FIG. 3) which is not shown for purposes of clarity. In particular embodiments, fastener 32 can be removed after seating of insert and receiver into the stock.

Figure 10:
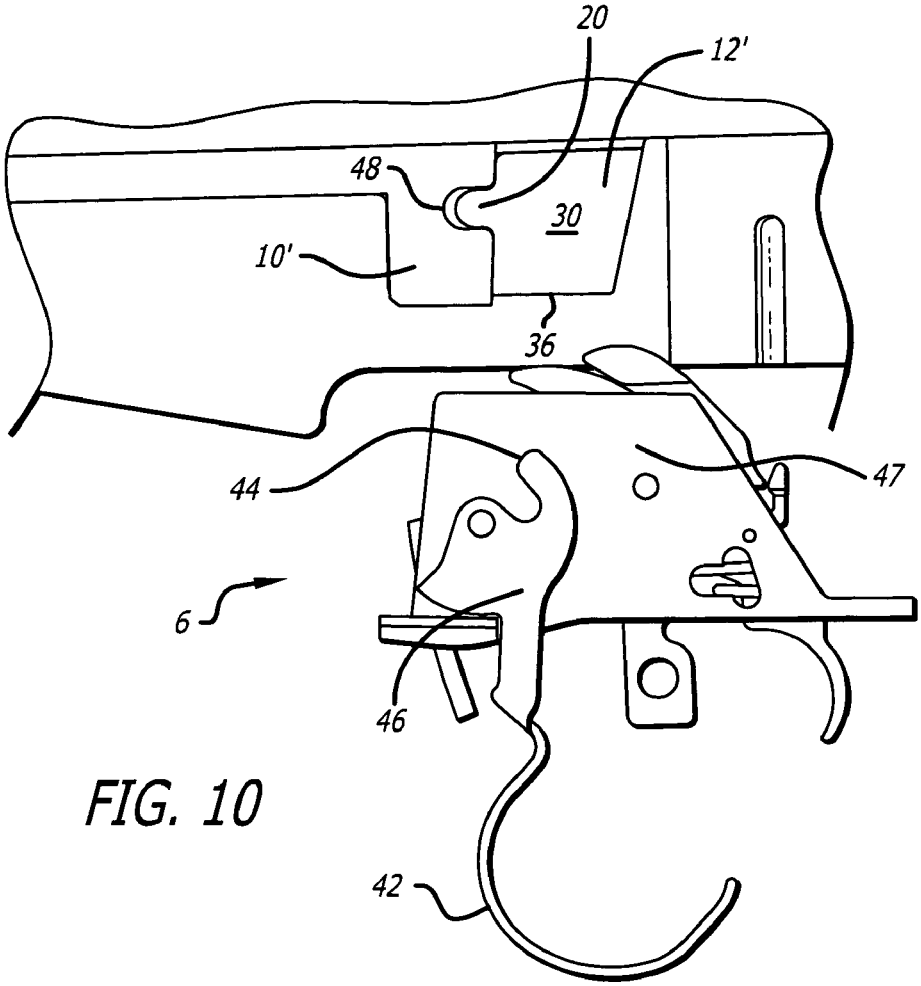
FIG. 10 is schematic depicting an exemplary trigger housing group including a hinged and pivotable trigger guard having two extension arms and two latch portions (one side shown here) before securing to an exemplary member depending from the receiver.

FIG. 10 is a schematic depicting an exemplary trigger housing group 6 including a hinged and pivotable trigger guard 42 having an extension arm 46 and latch portion 44 before securing the trigger housing group 6 to exemplary members 10 and 10' depending from receiver 4. This view of the stock and support railings is still provided along line 6-6 of the embodiment of FIG. 3, here showing only half of the components, that is, the distal or "prime" numbered components (e.g. insert 12' and depending member 10').

Figure 11:
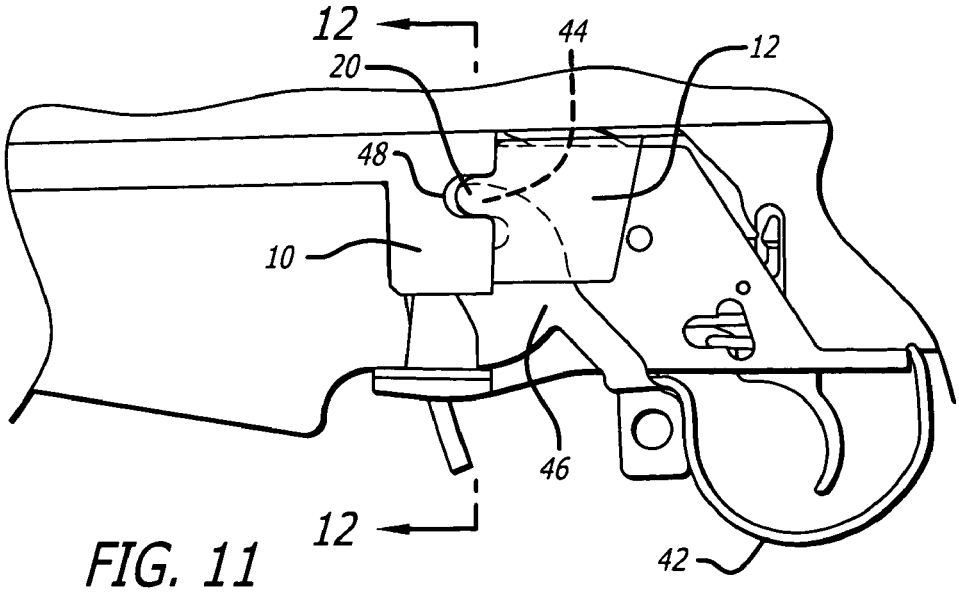
FIG. 11 is a schematic depicting the exemplary trigger housing group secured to a member depending from the receiver via forward positioning and latching of a latch portion of an extension arm.

FIG. 11 however, is a differing view showing additional more "proximal" components, generally showing depending member 10 and insert 12. With trigger housing group 6 inserted and secured to the receiver 4 via depending members 10' and 10, the distal "primer' numbered elements shown in FIGS. 8-10 are obscured. However, the overall configuration and spatial relationships of elements in this embodiment are mirrored. Therefore and referring also to FIG. 3, trigger housing group 6 is inserted into the open space of stock 2, bounded by support railing 5, and hinged and pivotable trigger guard 42, having a pair of extension arms (here only proximal extension arm 46 is shown) each having a respective latch portion 44 and 44' (see FIG. 3), is swung towards the trigger, thus resulting in engagement of latch portions 44 and 44' with their respective cut out portions 48 of depending members 10 or 10', respectively.

From the view provided in FIG. 11, the proximal insert 12, of the pair of inserts (toward the reader of the text), with protuberance 20 and depending member 10 with cut-out second mating portion 48 are shown, behind which proximal latch portion 44 is shown, securing the trigger housing group 6 thereto. In this embodiment, the exact same configuration and interaction of elements is mirrored on the distal side of the firearm. This is clearly shown when referencing FIG. 3 in conjunction with FIG. 11.

As shown in this embodiment, the receiver 4 is secured to the stock 2, via respective inserts, 12 and 12' and their mating and interlocking with the mating portions provided by receiver 4, here more particularly by depending members 10 and 10'. No longer is an interaction, that is, compression force, previously provided between trigger housing group 6 and depending member 10 and 10', by drawing these two components together, utilized or relied upon to secure receiver 4 to stock 2. Here and in accordance with the present teachings, the latch portions (44 and 44') of the trigger housing group 6 is simply utilized to secure the trigger housing group 6 to the firearm. The securing of the receiver 4 to the stock is now accomplished by the interaction between inserts 12 and 12', mating portions of depending members 10 and 10' and the seating of the inserts mated with and interlocking with depending members into appropriately shaped seating portions of the stock.

Figure 12:
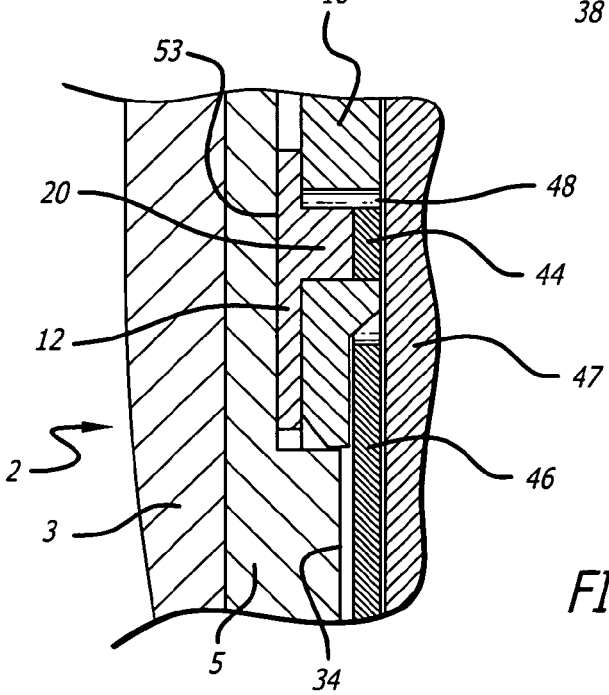
FIG. 12 is a cross section along line 12-12 of FIG. 11.

In order to provide another view of the relationship of various components, a cross section along line 12-12 of FIG. 11 is provided in FIG. 12. This cross section is a cross section of the "proximal" non-primed reference numbered half of the various elements (toward the reader of the text) in their final assembled configuration, looking forward, towards the barrel. Going from left to right and proceeding inward toward the midline of the assembled firearm, we first have stock 2 cross hatched, with outer portion 3, and adjacent thereto is support railing 5 with inward facing surface 34. Proximal insert 12 is shown having outward facing surface 53 and first mating portion, here protuberance 20. Interlocked and engaged therewith is the cut-out recess mating portion 48 of depending member 10. Adjacent thereto and also engaged with cut-out recess mating portion 48 of depending member 10 is latch portion 44 of extension arm 46. Innermost is a cross section of trigger housing group side-plate 47. It is noted that in this embodiment, depending members 10 and 10' are provided having sufficient thickness such that the cut-out mating portions 48 of the respective members can engage both the mating portion of inserts 12 and 12' along with the latch portions 44 and 44', respectively. Space shown regarding cut-out mating portions 48 is for illustration purposes, to show its cut out/recess. In use, the various interlocking and mating surfaces that engage surfaces of depending members 10 are in appropriate contact with each other to impart proper and sufficiently tight stability and securing functions of the various components with one another.

Figure 13:
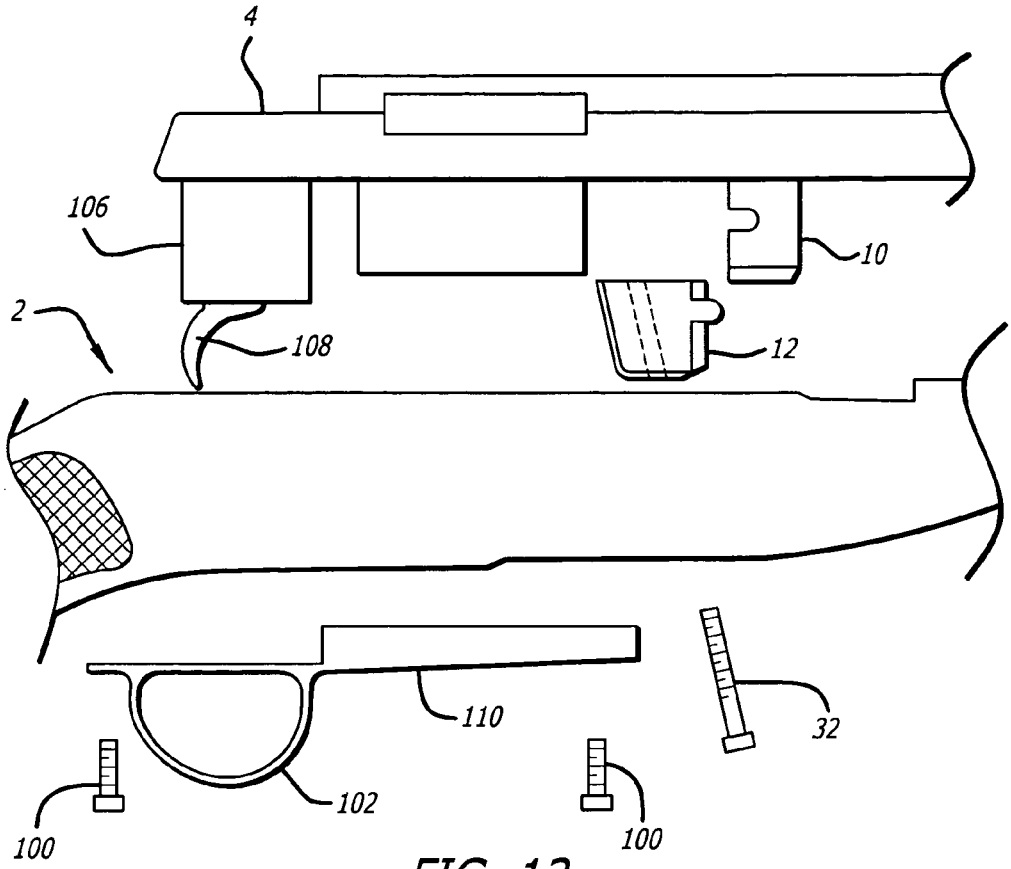
FIG. 13 is another exemplary embodiment in accordance with the present disclosure, shown in an unassembled configuration.

FIG. 13 is another exemplary embodiment in accordance with the present disclosure, shown in an unassembled configuration. Here receiver 4 also includes depending member 10 having an overall configuration in accordance with the teachings disclosed herein. Insert 12 and a seating portion (not shown) configured to accommodate and accept insert 12 is provided in accordance with the present disclosure. A trigger group 106, having a trigger 108 and associated components as well known in the art, are provided attached to receiver 4. A trigger guard 102 and associated floor plate 110 is also provided. While in this embodiment trigger guard 102 and associated floor plate 110 are provided as a separate component, in other embodiments, the trigger guard may be provided as an integral piece of stock 2, particularly when the stock is a molded or synthetic-type (e.g. not carved from a wood blank) stock.

Fastener 32, which runs through stock 2 and engages insert 12, in accordance with the disclosure provided herein, is also provided, to draw down and secure insert 12, having at least one inclined surface which is provided in accordance with the teachings disclosed herein. In this embodiment, trigger guard 102 and floor plate 110 are secured to the stock via fasteners 100 provided fore and aft the trigger guard. In this particular embodiment, unlike prior art fasteners, fasteners 100 are not provided having sufficient length to extend through the respective trigger guard 102 and floor plate 110 element and engage the receiver 4 via corresponding threaded channels provided at the underside of receiver 4 or barrel 8. In accordance with the teachings provided herein, such prior art fasteners and fastening are not required to secure the receiver/barrel to the stock when utilizing the fastening assembly and system disclosed herein. However, it is further contemplated that in particular embodiments, fasteners 100 can be utilized that do have sufficient length to length to extend through the respective trigger guard 102 and floor plate 110 element and engage the receiver 4 via corresponding threaded channels provided at the underside of receiver 4 or barrel 8, in addition to the fastening configurations provided in accordance with the teachings provided herein.

Figure 14:
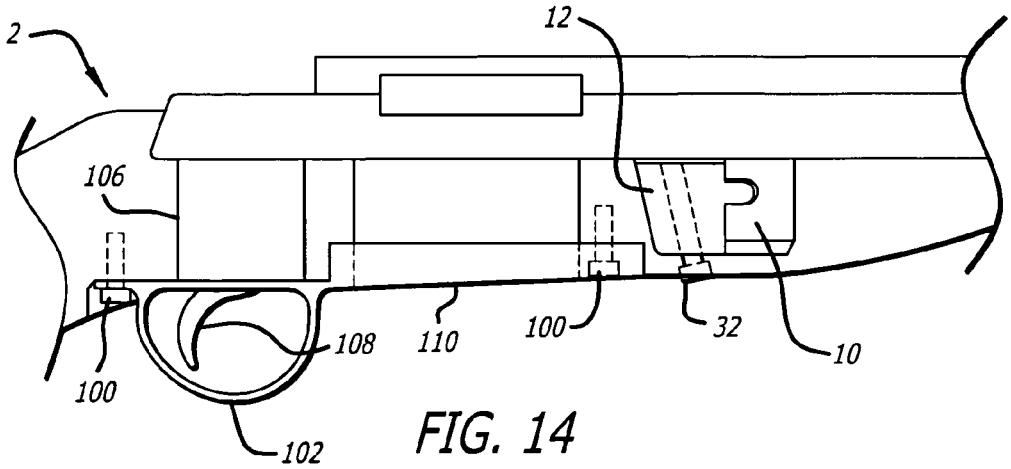
FIG. 14 is a partial cut-away cross section schematic showing the embodiment of FIG. 13 in an assembled configuration with an exemplary insert seated in the stock in accordance with the present disclosure and a trigger guard and floor plate secured to the stock via fasteners that do not contact the receiver.

As depicted in FIG. 14, wherein the firearm is shown in a cut-away cross-sectional view in its assembled state, insert 12 is engaged with depending member 10 which depends and is attached to receiver 4, the insert 12 being seated in an appropriately configured seating portion of stock 2, as shown and discussed previously. The seating portion, as previously shown and described, matches at least a portion of the overall contour of insert 12, so that insert 12, while engaged and interlocked with depending member 10, can fit and be fastened to stock 2. As before and in one embodiment, fastener 32 is provided to draw down and secure insert 12 (along with depending member 10). Fastener 32 can remain in hollow channel of insert 12, or be removed once insert and engaged receiver 4 are sufficiently and tightly secured. As mentioned previously, the overall wedge shape of insert 12 and its interaction with the correspondingly configured portions of seating portion of the stock results in tremendous security and fastening of the receiver 4 to the stock, not even necessitating the retention of fastener 32 once insert 12 and receiver 4 have been seated. This is because in this particular embodiment, as shown here and as disclosed herein, insert 12 has at least one inclined surface that engages at least one corresponding cam surface in the seating portion of stock 2. This wedge-shaped contour provides for very secure seating of insert 12 stock 2.

While only one insert 12 is shown in FIGS. 13 and 14, a plurality can be utilized and provided. For example, a pair of inserts may be provided to secure the receiver in the embodiment shown in FIGS. 13 and 14, provided of course that the corresponding mating and seating portions are provided in accordance with the present disclosure.

In still another aspect, the teachings of the present disclosure provide for a kit for retrofitting existing firearms which utilize prior art methodologies for securing receivers to stocks. For example, owners of M1A-type rifles can be provided with a kit that comprises a stock having a seating portion, preferably two which are opposing and have mirrored configurations, in accordance with the present disclosure, namely having at least one sidewall and at least one seating portion, the at least one seating portion being provided adjacent or integrated with the at least one sidewall and having an inclined cam surface. Also included would be at least one insert, but preferably two, since M1A-type rifle receivers have two depending members, which are analogous to depending members 10 and 10' as discussed herein, the at least one insert having an overall contour and top, bottom, front and rear surfaces, wherein at least one of the front or rear surfaces is an inclined surface and comports with the inclined cam surface of the corresponding seating portion of the stock. In accordance with the present teachings, the at least one insert is provided with at least a first mating portion, which can in one embodiment include a protuberance, that interlocks and fits with a complementary second mating portion of the firearm receiver. In this embodiment, each of the two depending members of M1A-type rifle receivers are already configured to provide the second mating portions thusly. Optionally, a fastener 32, for fastening the at least one insert into the at least one seating portion of the stock, is also provided and is utilized as disclosed herein. Furthermore, a plurality of inserts 12 can be provided having varying thickness, that is thickness separating inward facing surface 30 and outward facing surface 53 of insert 12, in order to provide a user a choice and method for adjusting and configuring the horizontal alignment of the receiver and barrel assembly relative to the stock, by utilizing various combinations of inserts having selected and particular thicknesses.

It is to be understood that the examples and embodiments described herein are for illustrative purposes only and that various modifications or changes in light thereof will be suggested to persons skilled in the art and are to be included within the spirit and purview of this application and scope of the appended claims and any combinations thereof.

What is claimed is:

1. A firearm fastening assembly for fastening one of a receiver or barrel to a stock, the assembly comprising:

at least one insert having at least a first mating portion, said at least one insert having top, bottom, front and rear surfaces each joining an inward facing surface and an outward facing surface;

at least one second mating portion provided as part of at least one of a receiver or barrel, said at least one second mating portion being configured to interlock with and mate with said at least first mating portion of said at least one insert; and a stock having at least one sidewall and at least one seating portion extending parallel to a longitudinal axis of the receiver or barrel, said at least one seating portion being provided adjacent or integrated with said at least one sidewall and dimensioned to correspond, at least in part, with at least a portion of said at least one insert and to accept said at least a portion of said at least one insert, wherein at least said front surface of said insert engages said second mating portion to transfer a recoil force that occurs during firearm firing from the second mating portion to the stock through the insert.

2. The firearm fastening assembly of claim 1, wherein said at least first mating portion of said at least one insert is a protuberance depending from said at least one insert.

3. The firearm fastening assembly of claim 2, wherein said at least one second mating portion comprises at least one recess into which said protuberance fits and interconnects.

4. The assembly of claim 1, wherein at least one of the top, bottom, front and rear surfaces is perpendicular to the inward facing surface of the insert.

5. A firearm fastening assembly for fastening one of a receiver or barrel to a stock, the assembly comprising:

at least one insert having at least a first mating portion, said at least one insert having top, bottom, front and rear surfaces perpendicular to an inward facing surface, said at least one insert having at least one of said front and rear surfaces including an inclined surface, said at least one inclined surface having an inclination relative to said top or bottom surfaces, said inclination forming greater than a ninety degree angle defined by said inclined surface and said bottom surface;

at least one second mating portion provided as part of or adjacent at least one of a receiver or barrel, said at least one second mating portion being configured to interlock with and mate with said at least first mating portion of said at least one insert;

a stock having at least one sidewall and at least one seating portion, said at least one seating portion being provided adjacent or integrated with said at least one sidewall and extending parallel to the receiver or barrel and dimensioned to correspond, at least in part, with at least a portion of said at least one insert and to accept said at least a portion of said at least one insert; and said at least one seating portion of said stock including a cam surface which is inclined and matches said at least one inclined surface, wherein at least said front surface of said insert engages said second mating portion to transfer a recoil force that occurs during firearm firing from the second mating portion to the stock through the insert.

6. The firearm fastening assembly of claim 5, wherein said at least one insert further comprises at least one rail portion depending from at least one of said inclined and bottom surfaces of said at least one insert.

7. The firearm fastening assembly of claim 6, wherein said at least one seating portion includes at least one groove into which said at least one rail portion of said at least one insert fits.

8. The firearm fastening assembly of claim 5, wherein said at least one second mating portion is provided as part of a member depending from said at least one of a receiver or barrel.

9. A firearm fastening assembly for fastening one of a receiver or barrel to a stock, the assembly comprising:

at least one insert having at least a first mating portion, said at least one insert having top, bottom, front and rear surfaces perpendicular to an inwardly facing surface, said at least one insert having at least one of said front and rear surfaces including an inclined surface, said at least one inclined surface having an inclination relative to said top or bottom surfaces, said inclination forming greater than a ninety degree angle defined by said inclined surface and said bottom surface;

at least one second mating portion provided as part of or adjacent at least one of a receiver or barrel, said at least one second mating portion being configured to interlock with and mate with said at least first mating portion of said at least one insert;

a stock having at least one sidewall and at least one seating portion parallel to the sidewall and to the receiver or barrel, said at least one seating portion being provided adjacent or integrated with said at least one sidewall and dimensioned to correspond, at least in part, with at least a portion of said at least one insert and to accept said at least a portion of said at least one insert; and a fastener configured to fasten the at least one insert to the at least one seating portion of the stock wherein said fastener of said at least one insert comprises a spirally grooved cylinder and said at least one insert includes a correspondingly grooved hollow cylinder into which said spirally grooved cylinder fits to seat said at lest one insert into said at least one seating portion of said stock, wherein at least said front surface of said insert engages said second mating portion to transfer a recoil force that occurs during firearm firing from the second mating portion to the stock through the insert.

10. A fastening assembly system for fastening a receiver of a firearm to a firearm stock, comprising:

a firearm receiver having a barrel attached thereto having a longitudinal axis;

at least one member depending from at least one of said firearm receiver or barrel;

a stock having a sidewall parallel to the longitudinal axis and at least one seating portion extending parallel to the longitudinal axis, said at least one seating portion being provided adjacent or integrated with said at least one sidewall and dimensioned to correspond, at least in part, with and receive at least a portion of an outer perimeter of at least one insert, the at least one insert having at least a first mating portion, wherein said at least first mating portion corresponds to and engages at least one second mating portion provided as part of said at least one member depending from said firearm receiver or barrel; and wherein said at least one insert includes top, bottom, front and rear surfaces joining an inward facing surface and an outward facing surface received in the seating portion, wherein at least said front surface of said insert engages said second mating portion to transfer a recoil force that occurs during firearm firing from the second mating portion to the stock through the insert.

11. The fastening assembly system in accordance with claim 10, wherein said first mating portion of said at least one insert is a protuberance having a first mating contour.

12. The fastening assembly system in accordance with claim 11, wherein said at least one protuberance is provided on a surface opposite said front or rear surface.

13. The fastening assembly system in accordance with claim 10, wherein said at least one insert includes at least one rail situated along at least a portion of said at least one insert's perimeter and corresponds to at least one groove of said seating portion of said stock into which said at least one insert fits.

14. The fastening assembly system in accordance with claim 10, wherein said at least one insert includes at least one rail situated along at least a portion of said at least one insert's perimeter and said at least one rail is substantially parallel to one of said front or rear surface.

15. A kit for fastening a firearm receiver having a longitudinal axis to a stock having at least one seating portion parallel to the longitudinal axis of the receiver, the kit comprising:

at least one insert, said at least one insert having top, bottom, front and rear surfaces joining an inward facing surface, said at least one insert having at least a first mating portion that interlocks and fits with a complementary second mating portion formed in one of a firearm receiver or stock having a mating inclined cam surface; and a fastener for fastening said at least one insert into said at least one seating portion of said stock such that the inward facing surface of the insert extends parallel to the longitudinal axis of the receiver, wherein at least said front surface of said insert engages said second mating portion to transfer a recoil force that occurs during firearm firing from the second mating portion to the stock through the insert.

16. The kit of claim 15, wherein said at least first mating portion of said at least one insert is a protuberance depending from said at least one insert configured to connect to a depending member of said one of the receiver or stock.

17. The kit of claim 15, wherein at least one of the top, bottom, front and rear surfaces is perpendicular to the inward facing surface of the insert.

* * * * *